US008082969B2

(12) United States Patent
Okachi

(10) Patent No.: US 8,082,969 B2
(45) Date of Patent: Dec. 27, 2011

(54) SCREEN DEVICE

(75) Inventor: Yasubumi Okachi, Kanagawa (JP)

(73) Assignee: Metaco Inc., Tokyo (JP)

( * ) Notice: Subject to any disclaimer, the term of this patent is extended or adjusted under 35 U.S.C. 154(b) by 138 days.

(21) Appl. No.: 12/467,524

(22) Filed: May 18, 2009

(65) Prior Publication Data

US 2010/0032109 A1 Feb. 11, 2010

(30) Foreign Application Priority Data

Aug. 6, 2008 (JP) ..... 2008-203550

(51) Int. Cl.
*E06B 3/94* (2006.01)

(52) U.S. Cl. ..... 160/84.06; 160/84.03

(58) Field of Classification Search ..... 160/84.06, 160/84.04, 84.03, 279
See application file for complete search history.

(56) References Cited

U.S. PATENT DOCUMENTS 5,351,737 A * 10/1994 Hoshiyama ..... 160/84.03
5,377,737 A * 1/1995 Moriya et al. ..... 160/84.06
5,477,904 A * 12/1995 Yang ..... 160/370.23
5,873,401 A * 2/1999 Tsuchida ..... 160/84.04
6,186,212 B1 * 2/2001 Tsuchida ..... 160/84.06
6,318,438 B1 * 11/2001 Uno et al. ..... 160/31
6,978,820 B2 * 12/2005 Aoki ..... 160/84.06
2006/0162871 A1 * 7/2006 Kamosawa et al. ..... 160/84.06
2007/0029053 A1 * 2/2007 Moriya et al. ..... 160/84.06
2007/0039698 A1 * 2/2007 Chino et al. ..... 160/84.06
2007/0068633 A1 * 3/2007 Chino et al. ..... 160/31

FOREIGN PATENT DOCUMENTS

JP 2749473 2/1998
JP 3403652 2/2003

* cited by examiner

*Primary Examiner* — David Purol
(74) *Attorney, Agent, or Firm* — Wenderoth, Lind & Ponack, L.L.P.

(57) ABSTRACT

A shrinkable and extensible screen is mounted between a pair of screen-mounting frame portions arranged bilaterally to confront each other and at least one being slidably movable. A tension member extending through the screen for supporting it in shrinking and extending directions is routed in the screen-mounting frame portions. The tension member is extracted at the portion close to the central portion from the upper end portion of the slidably movable screen-mounting frame portions, to the outside on the side opposite to the screen mounting side.

6 Claims, 11 Drawing Sheets

SCREEN DEVICE

BACKGROUND OF THE INVENTION (1) Field of the Invention

The present invention relates to a multipurpose screen device, which can be used as a curtain, a blind, a window screen, a partition or the like.

(2) Description of Related Art

As a device for realizing a smooth and stable opening and closing operation to be applied as shielding or dimming means such as a curtain or blind, or a window screen or a partition, the Applicant has provided the screen device (Japanese Patent No. 2,749,473 and Japanese Patent No. 3,403,652).

In the screen device described in Japanese Patent No. 2,749,473, a foldable and extensible screen member having a plurality of pleat portions is supported between a slide bar enabled to slide and move in opening and closing directions, and one frame portion arranged to confront the slide bar. Two intersecting wire members, which extend through the screen member in opening and closing directions and which are folded back inside of the slide bar by build-in direction changing means, are tensed between a pair of frame portions arranged to confront each other. The smooth and stable opening and closing operations are realized by those two wire members.

In the screen device described in Japanese Patent No. 3,403,652, a screen is so attached to a pair of screen-mounting frame portions which are arranged to confront each other and at least one of which can move slidably, as can shrink and extend freely between the two screen-mounting frame portions, and a pair of slide guide frame portions are arranged near the two end portions of the screen not on the mounting side of the screen-mounting frame portions. The slide guide frame portions are so formed that a rigid unit having a pair of sidewall portions arranged to confront each other and a bridge portion bridging the sidewall portions is turnably connected between the two adjoining rigid units. The slide guide frame portions are made bendable and have at least one end made free so that they can be housed in and extracted from the screen-mounting frame portions. As the slidably movable screen-mounting frame portions slide and move, the portions of the slide guide frame portions extracted from the screen-mounting frame portions keep the linearity. These slide guide frame portions realize the smooth and stable opening and closing operations thereby to eliminate the mounting restrictions.

The aforementioned screen device is widely used for its excellent opening and closing operation and workability. However, the size of the opening, in which the screen device is disposed, is divided into several standardized kinds. If the screen device is to be manufactured to match all the kinds, the screen device is divided into so many kinds as to raise problems in the aspects of the stable supply or stock control of products. In most cases, moreover, the size of the opening is made slightly different according to the constructing manner of the building. Even if standardized, the opening size has to be adjusted at the working site. Especially, the height of the screen device of the horizontal opening type has to be adjusted.

Generally, the screen device is shipped by considering the quality stability, after its major portions were assembled at the manufacturing factory. At the time of adjusting at the working site, therefore, the assembly is once broken and remade at the slide bar, the screen-mounting frame portions and the screen, and thus the construction of the device is complicated.

SUMMARY OF THE INVENTION

Thus, the invention has the following characteristics.

Firstly, a screen device, in which a shrinkable and extensible screen is mounted between a pair of screen-mounting frame portions arranged bilaterally to confront each other and at least one being slidably movable, and in which a tension member extending through the screen for supporting it in shrinking and extending directions is routed in the screen-mounting frame portions, characterized in that the tension member is extracted at the portion close to the central portion from the upper end portion of the slidably movable screen-mounting frame portions, to the outside on the side opposite to the screen mounting side.

Secondly, a screen device, in which a shrinkable and extensible screen is mounted between a pair of screen-mounting frame portions arranged bilaterally to confront each other and at least one being slidably movable, in which a slide guide frame portion is arranged near the lower end portion of the screen, in which a rigid unit including a pair of side wall portions arranged to confront each other and a bridge portion connecting the two side wall portions is turnably connected between the two adjoining rigid units, in which the slide guide frame portion is made bendable and has at least one free end so that it can be housed and extracted in the slidably movable screen-mounting frame portions and so that the extracted portion of the slide guide frame portion keeps its linearity when it is extracted from the screen-mounting frame portions as the screen-mounting frame portion slides and moves, characterized in that a tension member having its one end fixed at the free end of the slide guide frame portion is pulled into the slidably movable screen-mounting frame portions and is extracted at the portion close to the central portion from the upper end portion of the slidably movable screen-mounting frame portions, to the outside on the side opposite to the screen mounting side.

Thirdly, in the aforementioned second characteristic, the other end of the tension member is either fixed at a doorstop arranged to confront the slidably movable screen-mounting frame portions, or fixed at an upper rail for guiding the slide movement of the slidably movable screen-mounting frame portions at its upper end portion.

Fourthly, in the aforementioned third characteristic: both the paired screen-mounting frame portions are made slidably movable; the slide guide frame portion having two free ends can be housed in and extracted from the two screen-mounting frame portions; the other end of the tension member is fixed at the free end on the side opposite to the free end, at which one end is fixed in the slide guide frame portion; and the tension member, which is extracted at the portion close to the central portion from the upper end portion of the two slidably movable screen-mounting frame portions, to the outside on the side opposite to the screen mounting side, is pulled into the upper rail thereby to form a loop.

Fifthly, in the aforementioned fourth characteristic: a center pillar is arranged between the paired screen-mounting frame portions; the center pillar is made slidably movable in the same direction as that of the two screen-mounting frame portions; and at least one of one, or two or more tension members extending through the screen in shrinking and extending directions for supporting the screen is fixed on the center pillar.

DETAILED DESCRIPTION OF THE INVENTION

Figure 1:
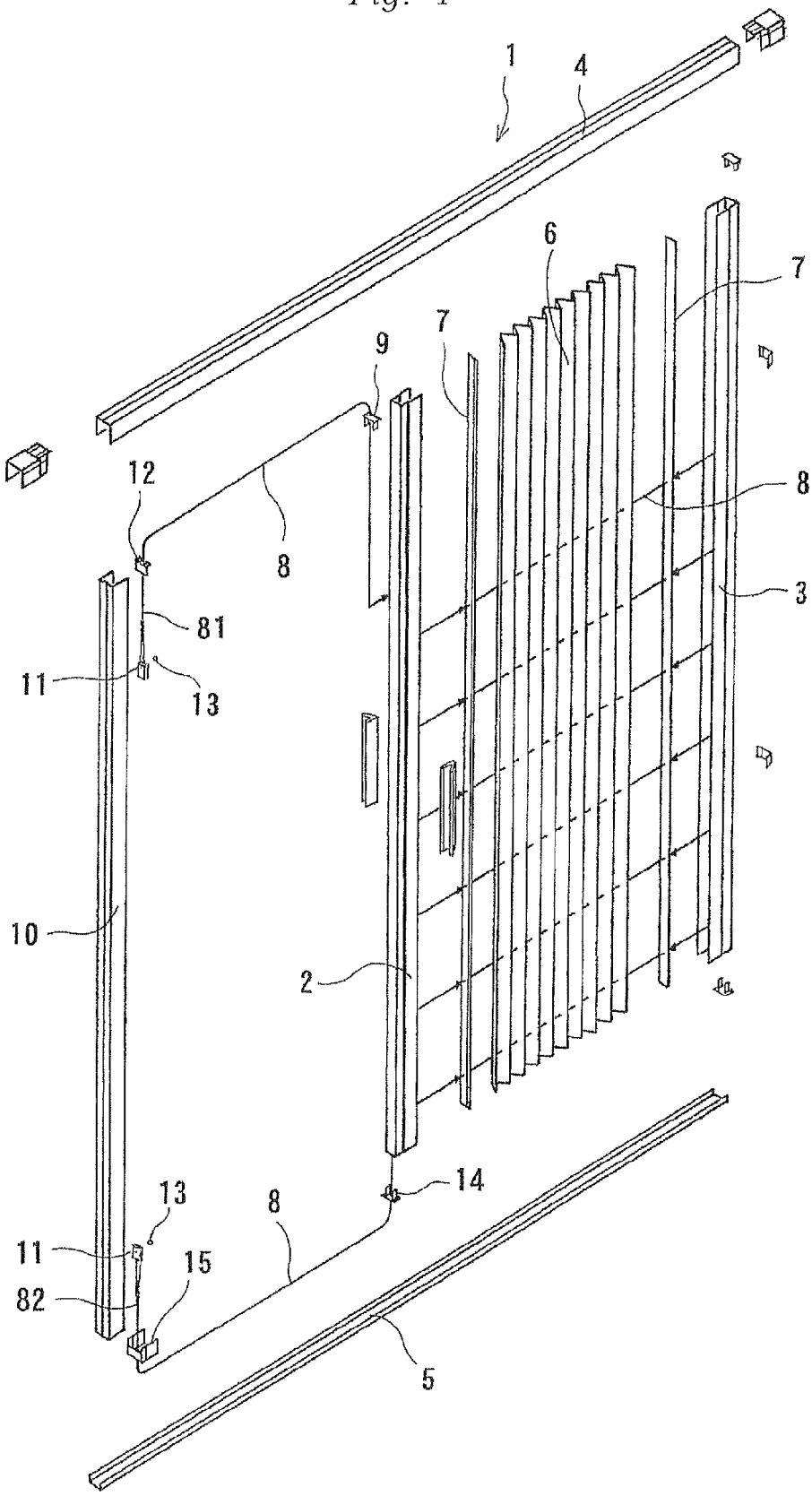
FIG. 1 is an exploded perspective view showing one embodiment of a screen device of the invention.

A screen device 1 shown in FIG. 1 has the aforementioned first feature.

In the screen device 1, there are arranged a pair of screen-mounting frame portions 2 and 3, of which the screen-mounting frame portion 2 is positioned on the left side whereas the screen-mounting frame portion 3 is positioned on the right side, so that they are arranged on the right and left sides to confront each other. Both the two screen-mounting frame portions 2 and 3 are vertically extending hollow bar-shaped members, and can be extrusion-molded of a light material such as aluminum. Moreover, the two screen-mounting frame portions 2 and 3 are formed to have a generally C-shaped shape in sections perpendicular to the longitudinal direction.

The screen-mounting frame portion 2 can slide to the right and left. In the screen device 1, there is arranged an upper rail 4 having a generally C-shaped section. This upper rail 4 is transversely mounted along the upper side of the inner edge of an opening of a building such as a door or window. In the screen device 1, moreover, a lower rail 5 is arranged below and oppositely of the upper rail 4. The lower rail 5 is transversely mounted along the lower side of the inner edge of the opening of the building. The screen-mounting frame portion 2 has its upper end portion fitted in the upper rail 4 and its lower end portion arranged on the lower rail 5. Therefore, the slide movements of screen-mounting frame portion 2 to the right and left are guided by the upper rail 4 and the lower rail 5 so that their stability is enhanced.

The screen-mounting frame portion 3 is fixed on the right side of the inner edge of the opening of the building, for example. The upper end portion of the screen-mounting frame portion 3 is also fitted in the upper rail 4 so that its appearance is made common.

Between these screen-mounting frame portions 2 and 3 thus constituted, there is mounted a screen 6. This screen 6 is pleated to have pleats so that it can be freely shrunken and extended between the screen-mounting frame portions 2 and 3. The screen 6 can be formed of a net, in case it is used as a window screen, so that it can also be formed of a sheet of cloth or resin in accordance with the application of the screen device 1. Moreover, the screen 6 can also be shrunken and extended not only by the pleats made by the pleating treatment but also by a honeycomb structure or the like.

The screen 6 is extended in the opening of a building, when the screen-mounting frame portion 2 slides to the left, thereby to perform the shading, dimming and insect-repelling functions. When the screen-mounting frame portion 2 slides to the right, on the other hand, the screen 6 is shrunken so that it is folded between the screen-mounting frame portions 2 and 3.

The screen 6 has support plates 7 attached to its two right and left end portions, so that it is attached to the screen-mounting frame portions 2 and 3 through the support plates 7. On the inner sides of the screen-mounting frame portions 2 and 3, there are arranged ribs, which protrude in widthwise directions. The support plate 7 is inserted on the left side of the rib into the screen-mounting frame portion 2 so that it engages with the rib thereby to mount the screen 6. The support plate 7 is inserted on the right side of the rib into the screen-mounting frame portion 3 so that it engages with the rib thereby to mount the screen 6. The engagement between the support plate 7 and the rib may be either a cantilever type or a center type, and adopts a suitable engaging type for an easy mounting work.

The folded and shrunken portion of the screen 6 is housed in the screen-mounting frame portion 2 on the right side of the rib and in the screen-mounting frame portion 3 on the left side. The screen-mounting frame portion 2 is moved so rightward that its right end face comes into contact with the left end face of the screen-mounting frame portion 3. At this time, the folded shrunken screen 6 is housed in the screen-mounting frame portions 2 and 3 so that it is not exposed to the outside.

In the screen device 1, moreover, there is arranged a tension member 8, which threads the screen 6 in the shrinking and extending directions. The tension member 8 has one end 81 and the other end 82, and is routed in the screen-mounting frame portions 2 and 3 so that both its one end 81 and other end 82 are let out from the slidable screen-mounting frame portion 2. The tension member 8 is a member for supporting the pleated screen 6, and retains the self-standing property of the screen 6 and enhances the facial strength. Moreover, the shrinkage and extension are guided by the tension member 8 so that they are smoothly performed. Still moreover, the tension member 8 homogenizes the operation load at the time of sliding the screen-mounting frame portion 2 to the right and left, thereby to smoothen the sliding operation.

There may be one or two, or more, of such tension members 8. Considering the aforementioned effect, moreover, the routing of the tension member 8 in the screen-mounting frame portion 2 may be so suitable as to acquire the necessary tension. For example, the one end 81 and the other end 82 may be intersected in the screen-mounting frame portion 2 and routed to each other, or not intersected but routed to each other, such that the one end 81 and the other end 82 are away from each other. A suitable wire for generating a tension such as rope or wire is adopted for the tension member 8. A suitable material is selected by considering durability or the like.

In the screen device 1, moreover, the side of the one end 81 of the tension member 8 is extracted at the portion close to the central portion from the upper end portion of the screen-mounting frame portion 2, to the outside on the side opposite to the mounting side of the screen 6. The extracted one end 81 of the tension member 8 is routed along the outer face of the screen-mounting frame portion 2 on the side opposite to the mounting side of the screen 6 of the screen-mounting frame portion 2 toward the upper end, and is bent to the left by hooking it on an upper cap 9 attached to the upper end portion of the screen-mounting frame portion 2, so that it is fixed through a fixing piece 11 on a doorstop 10 so arranged on the left as to confront the screen-mounting frame portion 2. The doorstop 10 is fixed on the left side of the inner edge of the opening of the building, thereby to define the left limit of the sliding movement of the screen-mounting frame portion 2. The doorstop 10 also has its upper end portion fitted in the upper rail 4 so that its appearance is also made common.

The side, which is hooked on the upper cap 9 and bent to the left, of the one end 81 of the tension member 8 is once pulled into the upper rail 4, and is hooked on an upper cap 12 mounted on the upper end portion of the doorstop 10 and bent downward, so that it is pulled into the doorstop 10. The side of the one end 81 of the tension member 8 has its leading end portion bound by the fixing piece 11 so that it is fixed at the doorstop 10 by fixing it on the doorstop 10 by means of a screw 13. The fixing piece 11 has its fixed position freely changed in the height direction of the doorstop 10 so that it can be fixed at a position for establishing a necessary tension by considering the length of the tension member 8 or the like.

Thus, the side of the one end 81 of the tension member 8 is extracted at the portion close to the upper end from the central portion of the screen-mounting frame portion 2, to the outside. The extracted side of the one end 81 is extended upward along the outer face of the screen-mounting frame portion 2 on the side opposite to the mounting side of the screen 6, and pulled into the upper rail 4 from the upper end of the screen-mounting frame portion 2 and then into the doorstop 10 from the upper end, so that the side of the one end 81 is not exposed to the opening of the building. The side of the one end 81 does not obstruct the opening and closing of a window or the coming and going of a personnel but presents a satisfactory appearance.

On the other hand, the side of the other end 82 of the tension member 8 is extracted from the lower end of the screen-mounting frame portion 2 to the outside, and is hooked by a lower cap 14, which is mounted on the lower end portion of the screen-mounting frame portion 2 and functions like the upper cap 9, so that it is bent to the left. The bent side of the other end 82 of the tension member 8 is extended to the left along the lower rail 5, and is hooked on a lower cap 15 mounted on the lower end portion of the doorstop 10 so that it is bent upward and pulled into the doorstop 10. The side of the other end 82 of the tension member 8 also has its leading end portion bound by the fixing piece 11 so that it is fixed at the doorstop 10 by fixing it on the doorstop 10 by means of the screw 13. The change of the fixing position of the fixing piece 11 is made like before. Thus, the side of the other end 82 of the tension member 8 is not exposed to the opening of the building, so that it does not obstruct the opening and closing of a window or the coming and going of a personnel but presents a satisfactory appearance. The side of the one end 81 and the side of the other end 82 are fixed in the doorstop 10 so that the necessary tension is applied to the tension member 8.

The screen device 1 is so assembled in and shipped from a factory that the screen 6 is mounted between the screen-mounting frame portions 2 and 3 and that the tension member 8 is wired. This wiring of the tension member 8 is performed so long that the one end 81 and the other end 82 are extracted from the screen-mounting frame portion 2 to the outside. In the working site, the screen device 1 is placed in that state at the opening of the building or the like.

The screen device 1 could have its sizes standardized to some extent by estimating the sizes of the opening of the building or the like, but is difficult to produce while matching the sizes of all openings. Moreover, it frequently occurs that the sizes of the opening are made slightly different by the fittings of the building. In case the screen device 1 is of the side-open type, therefore, the height size has to be adjusted according to the vertical size of the opening or the like.

Figure 2:
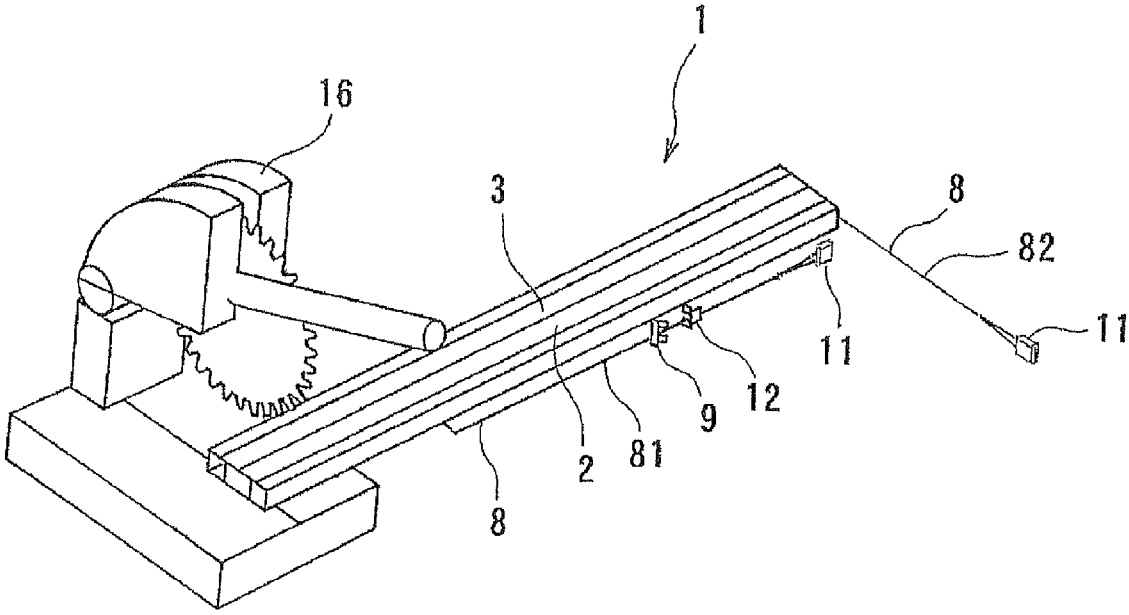
FIG. 2 is a perspective view illustrating an adjusting operation of the height size of the screen device shown in FIG. 1.

In the screen device 1, the tension member 8, which supports the screen 6 while extending therethrough in the shrinking and extending directions and which is routed in the screen-mounting frame portions 2 and 3, is extracted at the portion close to the central portion from the upper end portion of the slidable screen-mounting frame portion 2, to the outside on the side opposite to the mounting side of the screen 6. In case the height size of the screen device 1 is longer than the vertical size of the opening of the building, therefore, on the upper side of the portion, from which the tension member 8 is extracted to the outside, the screen device 1 is cut by means of a cutting tool such as an electric saw 16, as shown in FIG. 2, so that the height size can be cut so short as to match the height size of the opening or the like. By this cutting operation, the screen-mounting frame portions 2 and 3, the support plates 7 and the screen 6 are cut all at once, and this cutting operation can be performed without being obstructed by the tension member 8 but in the assembled state at the shipping time with the tension member 8 being wired. At this time, the upper cap 9 has been removed from the screen-mounting frame portion 2. The disassembling and reassembling operations to pull and cut and to wire the tension member 8 need not be performed to facilitate the adjustments by cutting the sizes short at the working site.

Figure 3:
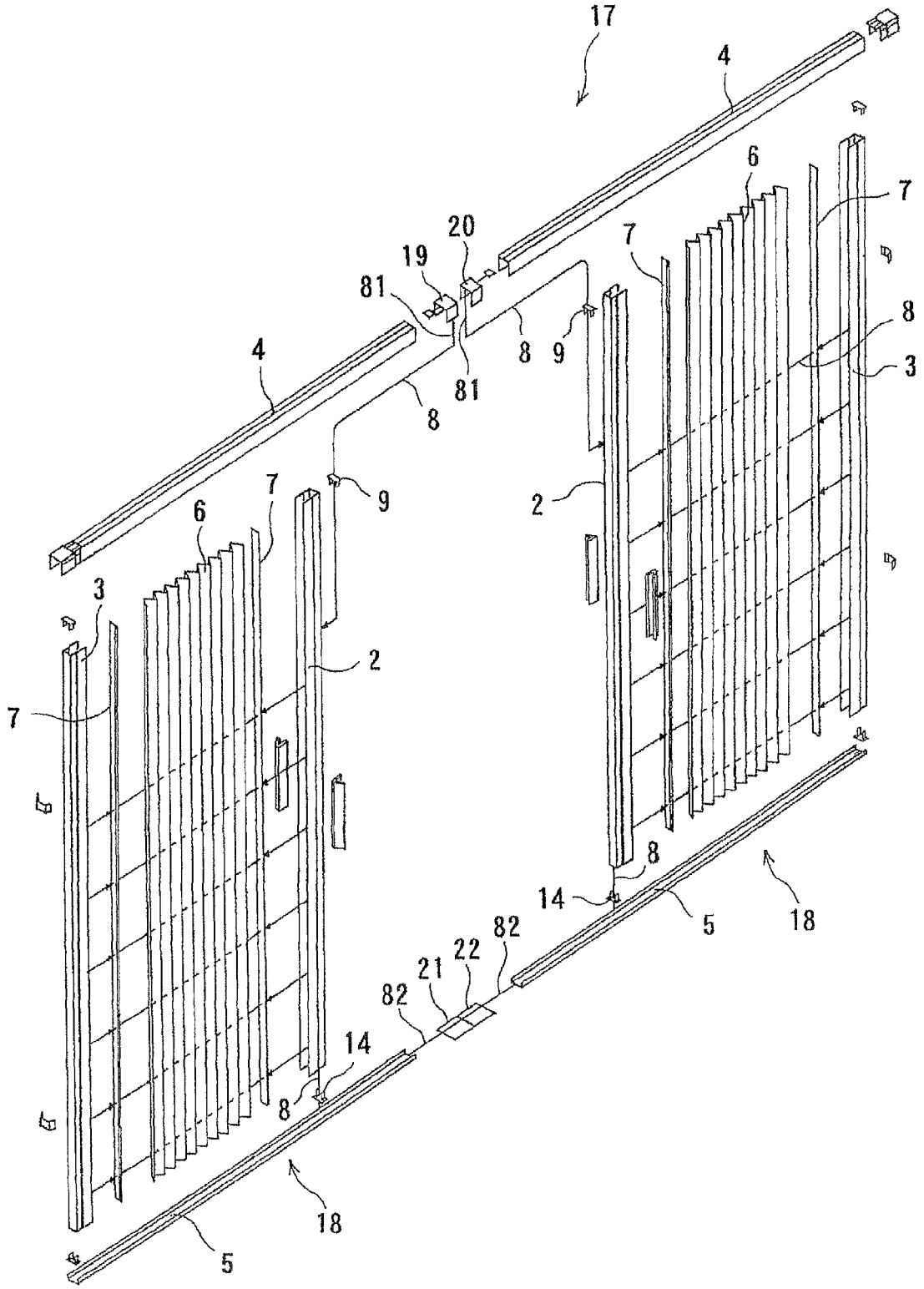
FIG. 3 is a perspective view showing one embodiment of the screen device of the invention, as based on the screen device shown in FIG. 1.

The screen device 1 shown in FIG. 1 is of the so-called single swing type, but a screen device 17 shown in FIG. 3 is of a double type. On the other and, the screen device 17 is based on the screen device 1 shown in FIG. 1. In the screen device 17, on the other hand, that portion of the screen device 1, from which the doorstop 10 and the fixing piece 11, the upper cap 12, the screw 13 and the lower cap 15 for fixing the side of the one end 81 and the side of the other end 82 of the tension member 8 on the doorstop 10 are removed, is made into a unit 18, and the two units 18 are arranged substantially symmetrically on the right and left sides.

In the screen device 17, moreover, at the left unit 18, the side of the one end 81, which is extracted to the outside from the screen-mounting frame portion 2 and bent at the upper cap 9 to extend to the right, of the tension member 8 is connected at its leading end portion to a right cap 19 to be mounted on the right end portion of the upper rail 4. Likewise, at the right unit 18, the side of the one end 81, which is extracted to the outside from the screen-mounting frame portion 2 and bent at the upper cap 9 to extend to the left, of the tension member 8, is connected at its leading end portion to a left cap 20 to be mounted on the left end portion of the upper rail 4 and having the same constitution of the right cap 19. By these connections to the right cap 19 and the left cap 20 thus mounted on the upper rail 4, the side of the one end 81 of the tension member 8 is fixed on the upper rail 4.

At the left unit 18, the side of the other end 82 of the tension member 8, which is extracted to the outside from the lower end of the screen-mounting frame portion 2 and bent at the lower cap 14 to extend to the right, is connected at its leading end portion to a fixing member 21 to be arranged on the right end portion of the lower rail 5. Likewise, at the right unit 18, the side of the other end 82 of the tension member 8, which is extracted to the outside from the lower end of the screen-mounting frame portion 2 and bent at the lower cap 14 to extend to the left, is connected at its leading end portion to a fixing member 22 to be arranged on the left end portion of the lower rail 5 and having the same constitution as that of the fixing member 21. By these connections to the fixing members 21 and 22, the sides of the one ends 81 of the tension members 8 are fixed on the lower side of the inner edge of the opening or the like. Moreover, the necessary tensions are applied to the tension members 8 arranged in the right and left units 18, and the sides of the one ends 81 and the sides of the other ends 82 are individually pulled into the upper rails 4 and extended to the left along the lower rails 5 so that they are not exposed to the opening or the like of the building. The sides of the one ends 81 and the other ends 82 do not obstruct the opening and closing of the window or the coming and going of the personnel but presents satisfactory appearances.

In the screen device 17, the aforementioned two units 18 are arranged substantially symmetrically on the right and left sides. As in the screen device 1 shown in FIG. 1, therefore, on the upper side of the portion, from which the tension member 8 is extracted to the outside of the slidably movable screen-mounting frame portion 2, the unit 18 is cut by means of a cutting tool such as the electric saw 16, as shown in FIG. 2, so that the height size can be cut so short as to match the height size of the opening or the like. At this time, in the right and left units 18, the upper caps 9 have been removed from the screen-mounting frame portion 2 so as to facilitate the adjustments by cutting the sizes short at the working site.

Figure 4:
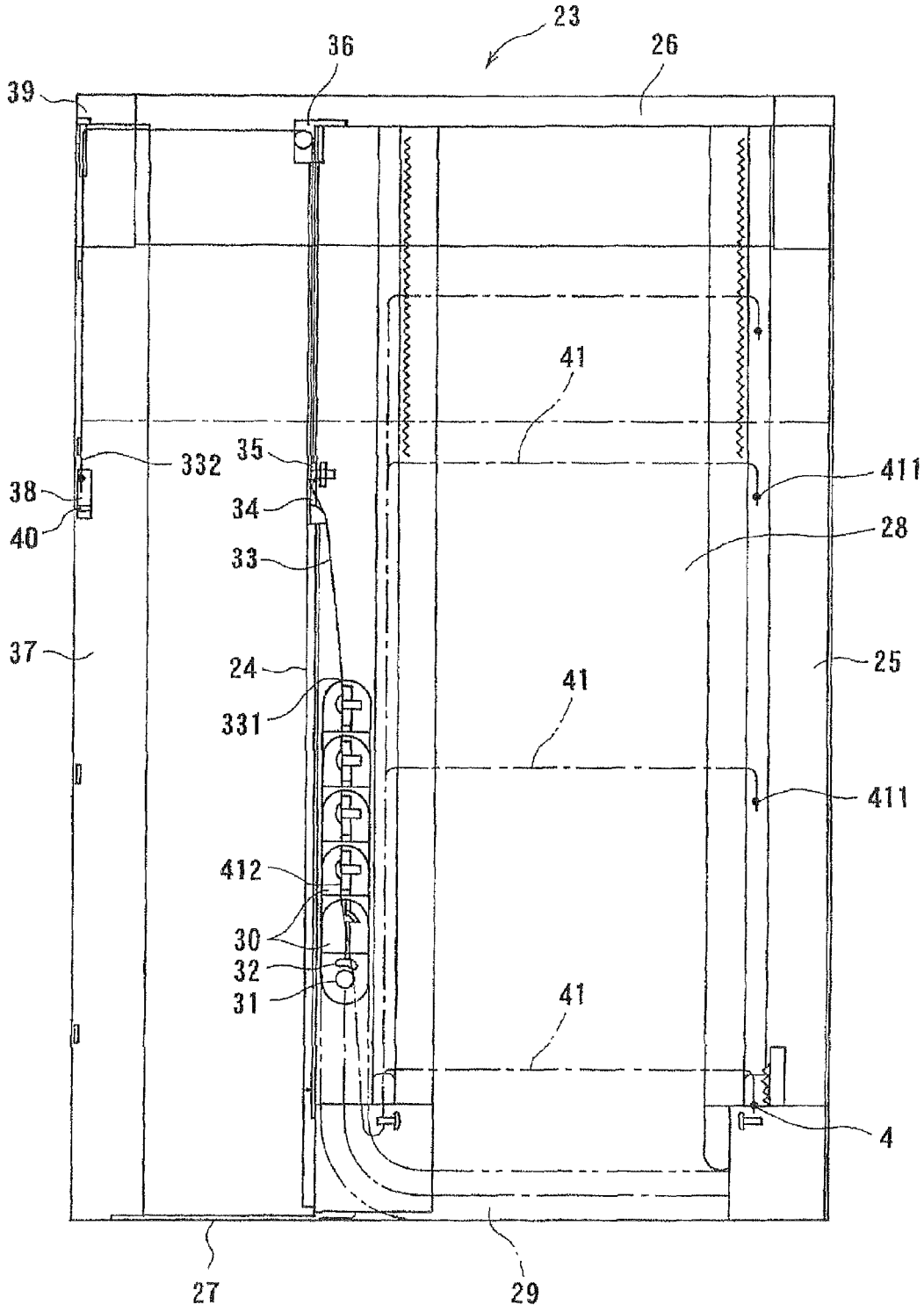
FIG. 4 is a front elevation showing one embodiment of the screen device of the invention.

A screen device 23 shown in FIG. 4 has the aforementioned second feature.

In the screen device 23, there are arranged a pair of screen-mounting frame portions 24 and 25, of which the screen-mounting frame portion 24 is positioned on the left side whereas the screen-mounting frame portion 25 is positioned on the right side, so that they are arranged on the right and left sides to confront each other. Both the two screen-mounting frame portions 24 and 25 are vertically extending hollow bar-shaped members, and can be extrusion-molded of a light material such as aluminum. Moreover, the two screen-mounting frame portions 24 and 25 are formed to have a generally C-shaped shape in sections perpendicular to the longitudinal direction.

The screen-mounting frame portion 24 can slide to the right and left. In the screen device 23, there is arranged an upper rail 26 having a generally C-shaped section. This upper rail 26 is transversely mounted along the upper side of the inner edge of an opening of a building such as a door or window. In the screen device 23, moreover, a lower rail 27 is arranged below and oppositely of the upper rail 26. The lower rail 27 is transversely mounted along the lower side of the inner edge of the opening of the building. The screen-mounting frame portion 24 has its upper end portion fitted in the upper rail 26 and its lower end portion arranged on the lower rail 27. Therefore, the slide movements of screen-mounting frame portion 24 to the right and left are guided by the upper rail 26 and the lower rail 27 so that their stability is enhanced.

The screen-mounting frame portion 25 is fixed on the right side of the inner edge of the opening of the building, for example. The upper end portion of the screen-mounting frame portion 25 is also fitted in the upper rail 26 so that its appearance is made common.

Between these screen-mounting frame portions 24 and 25 thus constituted, there is mounted a screen 28. This screen 28 is pleated to have pleats, although not shown, so that it can be freely shrunken and extended between the screen-mounting frame portions 24 and 25. The screen 28 can be formed of a net, in case the screen device 23 is used as a window screen, so that it can also be formed of a sheet of cloth or resin in accordance with the application of the screen device 23. Moreover, the screen 28 can also be shrunken and extended not only by the pleats made by the pleating treatment but also by a honeycomb structure or the like.

The screen 28 is extended in the opening of a building, when the screen-mounting frame portion 24 slides to the left, thereby to perform the shading, dimming and insect-repelling functions. When the screen-mounting frame portion 24 slides to the right, on the other hand, the screen 28 is shrunken so that it is folded between the screen-mounting frame portions 24 and 25. The folded and shrunken portion of the screen 28 is housed in the screen-mounting frame portion 24 on the right side and in the screen-mounting frame portion 25 on the left side. The screen-mounting frame portion 24 is moved so rightward that its right end face comes into contact with the left end face of the screen-mounting frame portion 25. At this time, the folded shrunken screen 28 is housed in the screen-mounting frame portions 24 and 25 so that it is not exposed to the outside.

In the screen device 23, moreover, a slide guide frame portion 29 is arranged near the lower end portion of the screen 28. The slide guide frame portion 29 is formed such that rigid units 30 can turn freely between the two adjoining ones. The slide guide frame portion 29 can be exemplified by one, which is described in Japanese Patent No. 3403652 and thus far provided. The rigid unit 30 includes a pair of sidewall portions arranged to confront each other, and a bridge portion connecting the two sidewall portions to each other, although partially omitted for simplicity of illustration. In the sidewall portions, outward protrusions are arranged in longitudinal one-end portions, and through holes 31 engageable with the protrusions are formed in the other end portions. In the side wall portions, moreover, outward small protrusions are arranged adjacent to the aforementioned protrusions and at the positions opposite of the through holes 31, and substantially crescent slots 32 are formed adjacent to the through holes 31 and in the sides of the aforementioned protrusions. The two adjacent ones of those rigid units 30 are turnably jointed to form the slide guide frame portion 29, by fitting the aforementioned protrusions in the through holes 31 from the inner sides of the side wall portions and by inserting the aforementioned small protrusions into the slots 32. As a result, the slide guide frame portion 29 is made bendable, and the aforementioned small protrusions contact the longitudinal one-side ends of the slots 32 so that the linearity can be held by regulating the turning motions of the rigid units 30.

The slide guide frame portion 29 is fixed at its right end on the screen-mounting frame portion 25. On the other hand, the left end of the slide guide frame portion 29 is made free so that it can be housed in and extracted from the screen-mounting frame portion 24 made slidably movable. When the screen-mounting frame portion 24 is made to slide leftward, the slide guide frame portion 29 is extracted from the screen-mounting frame portion 24, and this extracted portion keeps straight. When the screen-mounting frame portion 24 is made to slide rightward, on the other hand, the slide guide frame portion 29 is bent at the lower end portion of the screen-mounting frame portion 24 so that it is housed in the screen-mounting frame portion 24. These housing and extracting operations of the slide guide frame portion 29 in and from the screen-mounting frame portion 24 are performed synchronously with the shrinkage and extension of the screen 28. The slide guide frame portion 29 is not exposed to the opening or the like of the building, so that it does not obstruct the opening and closing of the window or the coming and going of the personnel but presents a satisfactory appearance.

In the screen device 23, moreover, there is arranged a tension member 33. This tension member 33 has one end 331 and the other end 332, of which the one end 331 is fixed at the free end of the left-end side of the slide guide frame portion 29 so that it is pulled into the slidably movable screen-mounting frame portion 24. Moreover, the tension member 33 is extracted at the portion close to the central portion from the upper end portion of the screen-mounting frame portion 24, to the outside on the side opposite of the mounting side of the screen 28. At the portion where the tension member 33 is extracted from the screen-mounting frame portion 24 to the outer side, there is arranged a crank piece 34 for lightening the friction. This crank piece 34 is fixed on the screen-mounting frame portion 24 by a screw 35.

The extracted other end 332 of the tension member 33 is routed along the outer face of the screen-mounting frame portion 24 on the side opposite to the mounting side of the screen 28 toward the upper end of the screen-mounting frame portion 24, and is bent to the left by hooking it on an upper cap 36 attached to the upper end portion of the screen-mounting frame portion 24, so that it is fixed through a fixing piece 38 on a doorstop 37 so arranged on the left as to confront the screen-mounting frame portion 24. The doorstop 37 is fixed on the left side of the inner edge of the opening of the building, thereby to define the left limit of the sliding movement of the screen-mounting frame portion 24. The doorstop 37 also has its upper end portion fitted in the upper rail 26 so that its appearance is also made common.

The side, which is hooked on the upper cap 36 and bent to the left, of the other end 332 of the tension member 33 is once pulled into the upper rail 26, and is hooked on an upper cap 39 mounted on the upper end portion of the doorstop 37 and bent downward, so that it is pulled into the doorstop 37. The side of the other end 332 of the tension member 33 has its leading end portion bound by the fixing piece 38 so that it is fixed at the doorstop 37 by fixing it on the doorstop 37 by means of a screw 40. The fixing piece 38 has its fixed position freely changed in the height direction of the doorstop 37 so that it can be fixed at a position for establishing a necessary tension by considering the length of the tension member 33 or the like.

Thus, the side of the other end 332 of the tension member 33 is extracted at the portion close to the upper end from the central portion of the screen-mounting frame portion 24, to the outside. The extracted side of the other end 332 is extended upward along the outer face of the screen-mounting frame portion 24 on the side opposite to the mounting side of the screen 28, and pulled into the upper rail 26 from the upper end of the screen-mounting frame portion 24 and then into the doorstop 37 from the upper end, so that the side of the other end 332 is not exposed to the opening of the building. The side of the other end 332 does not obstruct the opening and closing of a window or the coming and going of a personnel but presents a satisfactory appearance.

Here, the side of the other end 332 of the tension member 33 can also be fixed not on the doorstop 37 but on the left end portion of the upper rail 26 through the fixing piece 38 as long as it is not exposed to the opening of the building or the like. In case the side of the other end 332 of the tension member 33 is fixed on the left end portion of the upper rail 26, the doorstop 37 can be omitted to reduce the parts of the screen device 23 thereby to facilitate the stock control.

When the screen-mounting frame portion 24 is slid to move to the left in the screen device 23, the screen-mounting frame portion 24 is enabled, by the tension on the slide guide frame portion 29 and the tension member 33, to keep the parallel state with respect to the screen-mounting frame portion 25 fixed. When the screen-mounting frame portion 24 is slid to move to the right, on the other hand, the screen-mounting frame portion 24 is enabled, by the tension to act on the tension member 33 and the compression to act on the slide guide frame portion 29, to keep the parallel state with respect to the fixed screen-mounting frame portion 25. As a result, the screen-mounting frame portion 24 can slide and move smoothly while being stable to the right and left, and the operation load of the screen-mounting frame portion 24 is homogenized to smoothen the sliding operation.

Here, a suitable wire for generating a tension such as rope or wire is adopted for the tension member 33. A suitable material is selected by considering durability or the like.

In the screen device 23, moreover, there is arranged a tension member 41, which extends through the screen 28 in the shrinking and extending directions so as to support the pleated screen 28 in accordance with the size or the like of the screen 28. As in the tension member 33, a suitable wire for generating a tension such as rope or wire is adopted for the tension member 41, and a suitable material is selected by considering durability or the like. The number of tension member 41 may be one, or two or more. In the case of a plural number, the tension members 41 may be arranged vertically of the screen 28 at a constant interval.

The tension member 41 has its one end 411 fixed in the screen-mounting frame portion 25 and its other end 412 routed in the screen-mounting frame portion 24 and fixed on the free end of the left side of the slide guide frame portion 29. The routing method of the tension member 41 in the screen-mounting frame portion 24 is not especially limited, but can be exemplified for acquiring a necessary tension, by bending it once downward and by bending it upward at the lower end portion of the screen-mounting frame portion 24.

The tension member 41 can retain the self-standing property of the screen 28 and can enhance the facial strength. Moreover, the shrinkage and extension are guided by the tension member 41 so that they are smoothly performed.

The screen device 23 is so assembled in and shipped from a factory that the screen 28 is mounted between the screen-mounting frame portions 24 and 25, that the slide guide frame portion 29 is arranged near the lower end portion of the screen 28, and that the tension members 33 and 41 are wired. This wiring of the tension member 33 is performed so long that the side of the other end 332 is extracted from the screen-mounting frame portion 24 to the outside. In the working site, the screen device 23 is placed in that state at the opening of the building or the like.

The screen device 23 could have its sizes standardized to some extent by estimating the sizes of the opening of the building or the like, but is difficult to produce while matching the sizes of all openings. Moreover, it frequently occurs that the sizes of the opening are made slightly different by the fittings of the building. In case the screen device 23 is of the side-open type, therefore, the height size has to be adjusted according to the vertical size of the opening or the like.

In the screen device 23, as described hereinbefore, the tension member 33, which is supported at its one end 331 by the free end of the slide guide frame portion 29 and which is pulled into the screen-mounting frame portion 24, is extracted at the portion close to the central portion from the upper end portion of the slidable screen-mounting frame portion 24, to the outside on the side opposite to the mounting side of the screen 28. In case the height size of the screen device 23 is longer than the vertical size such as the opening of the building, therefore, on the upper side of the portion, from which the tension member 33 is extracted to the outside, the screen device 23 is cut by means of a cutting tool such as an electric saw, so that the height size can be cut so short as to match the height size of the opening or the like. By this cutting operation, the screen-mounting frame portions 24 and 25 and the screen 28 are cut all at once, and this cutting operation can be performed without being obstructed by the tension members 33 and 41 and the slide guide frame portion 29 but in the assembled state at the shipping time with the tension members 33 and 41 being wired. The disassembling and reassembling operations to pull, cut and wire the tension members 33 and 41 and to demount and mount the slide guide frame portion 29 once and again need not be performed to facilitate the adjustments by cutting the sizes short at the working site.

Figure 5:
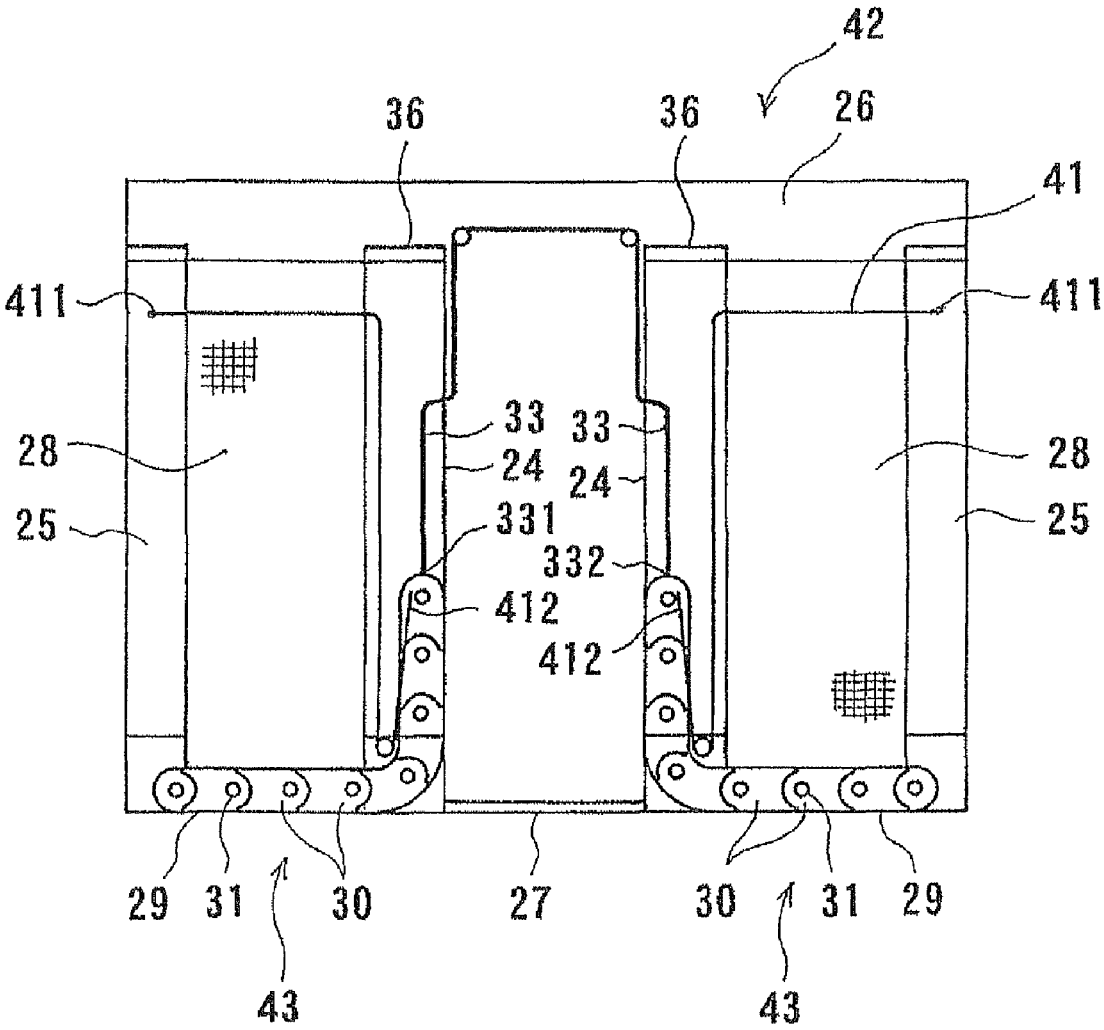
FIG. 5 is a front elevation showing one embodiment of the screen device of the invention, as based on the screen device shown in FIG. 4.

The screen device 23 shown in FIG. 4 is of the so-called single swing type, but a screen device 42 shown in FIG. 5 is of a double type. The screen device 42 is based on the screen device 23 shown in FIG. 4. In the screen device 42, on the other hand, that portion of the screen device 23, from which the doorstop 37 and the fixing piece 38 for fixing the side of the other end 332 of the tension member 33 on the doorstop 37 are removed, is made into a unit 43, and the two units 43 are arranged substantially symmetrically on the right and left sides. In the screen device 42, moreover, the upper rail 26 and the lower rail 27 are commonly used in the two units 43.

In the screen device 42, moreover, at the left unit 43, the side of the other end 332, which is extracted to the outside from the screen-mounting frame portion 24 and bent at the upper cap 36 to extend to the right, of the tension member 41 is pulled into the upper rail 26, hooked and bent downward by the upper cap 36 mounted on the upper end portion of the screen-mounting frame portion 24 of the right unit 43, routed in the screen-mounting frame portion 24 of the right unit 43, so that the other end 332 is fixed on the free end of the slide guide frame portion 29 of the right unit 43. In short, in the screen device 42, the tension member 33 is shared between the two right and left units 43. The necessary tensions are applied to the tension members 33 thus arranged in the right and left units 43 and having the one end 331 and the other end 332 fixed individually on the slide guide frame portion 29, and the tension members 33 are pulled into the screen-mounting frame portion 24 of the two units 43 and into the upper rail 26 so that they are not exposed to the opening or the like of the building. The tension members 33 do not obstruct the opening and closing of the window or the coming and going of the personnel but presents satisfactory appearances.

In the screen device 42, the aforementioned units 43 are arranged substantially symmetrically on the right and left sides. As in the screen device 23 shown in FIG. 4, therefore, on the upper side of the portion, from which the tension member 33 is extracted to the outside of the slidably movable screen-mounting frame portion 24, the unit 43 is cut by means of a cutting tool such as the electric saw, so that the height size can be cut so short as to match the height size of the opening or the like. At this time, in the two units 43, the upper caps 36 have been removed from the screen-mounting frame portion 24 so as to facilitate the adjustments by cutting the sizes short at the working site.

Moreover, the doorstop 37 is omitted, and the screen device 42 uses the upper rail 26 and the lower rail 27 commonly in the right and left units 43, so that the parts can be further reduced to facilitate the stock control.

Here, the other end 332 of the tension member 33 is not fixed, when shipped from the factory, on the slide guide frame portion 29 of the right unit 43 but is fixed, after adjusted, on the free end of the slide guide frame portion 29, so that the mounting work of the screen device 42 can be further facilitated. In this case, in order to facilitate the fixing of the other end 332 of the tension member 33, it is possible to make the crank piece 34, as shown in FIG. 4, into a longitudinal member and to form a long slit to provide the communication between the inside and outside of the screen-mounting frame portion 24 in the crank piece 34. Through this slit, the side of the other end 332 of the tension member 33 can be easily pulled into the screen-mounting frame portion 24 of the right unit 43, so that it can be easily fixed on the free end of the slide guide frame portion 29.

Figure 6:
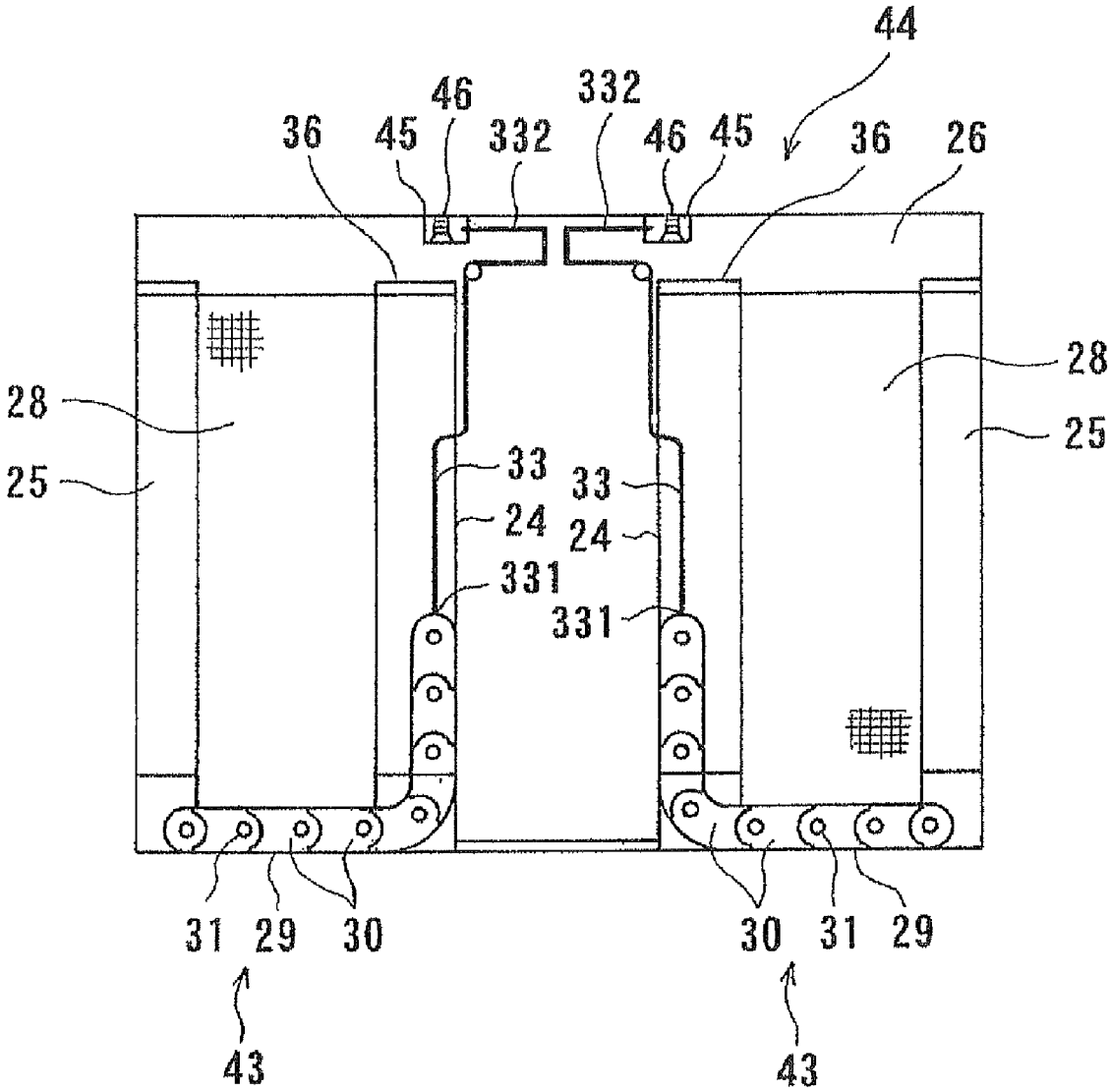
FIG. 6 is a front elevation showing one embodiment of the screen device of the invention, as a modification of the screen device shown in FIG. 5.

A screen device 44 shown in FIG. 6 is essentially different from the screen device 42 shown in FIG. 5, in that the tension member 33 is not shared between the right and left units 43.

In the left unit 43, the side of the other end 332 of the tension member 33, which is extracted from the screen-mounting frame portion 24 to the outside and which is bent at the upper cap 9 and extends to the right, is pulled in the upper rail 26, and bent upward and leftward at the upper end portion of the upper rail 26. Moreover, a fixing piece 45 for functioning like the fixing piece 38 shown in FIG. 4 is bound to the other end 332, and the fixing piece 45 is fitted in the groove formed in the upper end portion of the upper rail 26, and is fixed by a screw 46. The fixed position of the fixing piece 45 can be changed in the longitudinal direction of the upper rail 26. The other end 332 is fixed on the upper rail 26 through the fixing piece 45 so that the necessary tension is applied to the tension members 33.

In the right unit 43, too, the side of the other end 332 of the tension member 33, which is extracted from the screen-mounting frame portion 24 to the outside and which is bent at the upper cap 9 and extends to the left, is pulled in the upper rail 26, and bent upward and rightward at the upper end portion of the upper rail 26. Moreover, the fixing piece 45 is bound to the other end 332, and the fixing piece 45 is fitted in the groove formed in the upper end portion of the upper rail 26, and is fixed by the screw 46. The fixed position of the fixing piece 45 can be changed in the longitudinal direction of the upper rail 26. The other end 332 is fixed on the upper rail 26 through the fixing piece 45 so that the necessary tension is applied to the tension members 33.

Moreover, both the tension members 33 arranged in the right and left units 43 are pulled into the inside of the upper rail 4 so that they are not exposed to the opening or the like of the building. The tension members 33 do not obstruct the opening and closing of the window or the coming and going of the personnel but presents satisfactory appearances.

Here, the tension member 41 is omitted from the screen device 44. As in the screen device 42 shown in FIG. 5, and as in the screen device 23 shown in FIG. 4, one, or two or more tension members 41 can be arranged to extend through the screen 28 in the shrinking and extending directions, thereby to support the same.

This screen device 44 achieves effects like those of the screen device 42 shown in FIG. 5.

Figure 7:
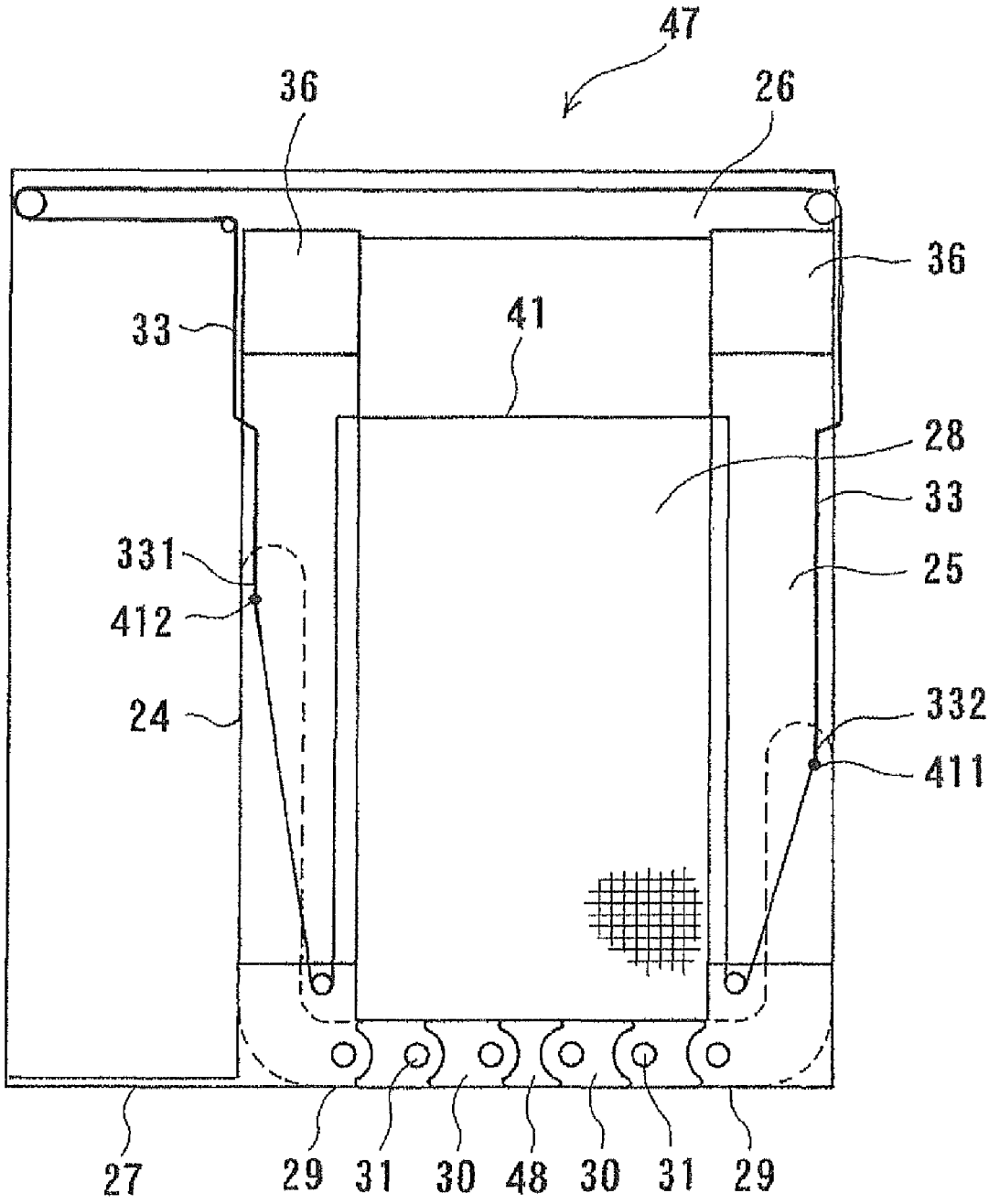
FIG. 7 is a front elevation showing one embodiment of the screen device of the invention, as a modification of the screen device shown in FIG. 4.

In the screen device 47 shown in FIG. 7, the right screen-mounting frame portion 25 can slide to the right and left like the left screen-mounting frame portion 24. Moreover, the slide guide frame portion 29 arranged near the lower end portion of the screen 28 is given the free ends at both the two right and left ends, so that it is not fixed by the screen-mounting frame portion 25 so that it can be housed in and extracted from the screen-mounting frame portion 25. When the screen-mounting frame portion 25 is slid to the right, the slide guide frame portion 29 is extracted from the screen-mounting frame portion 25, and the extracted portion keeps the straightness. When the screen-mounting frame portion 25 is slid to the left, the slide guide frame portion 29 is bent at the lower end portion of the screen-mounting frame portion 25 and housed in the screen-mounting frame portion 25. These housing and extracting operations of the slide guide frame portion 29 in the screen-mounting frame portion 25 are performed synchronously with the shrinkage and extension of the screen 28.

The slide guide frame portion 29 has a structure, in which a connecting member 48 is arranged at the central portion of the longitudinal direction and which is substantially symmetric with respect to the connecting member 48, so that it may be smoothly housed in and extracted from the two screen-mounting frame portions 24 and 25. The connecting member 48 can be given such a structure corresponding to the rigid units 30 of the connection end in the slide guide frame portion 29, as can be exemplified by including a pair of side wall portions arranged to confront each other, and a bridge portion connecting the two side wall portions to each other. In the sidewall portions, there are arranged protrusions protruding to the outside from the two longitudinal end portions. These protrusions are given substantially the same shape and size as those of the protrusions of the rigid units 30 so that they can engage with the through holes 31 of the rigid units 30. In the sidewall portions, moreover, substantially crescent protrusions are arranged on the end edge side and adjacent to the protrusions, and are made engageable with the substantially crescent slots 32 of the rigid unit 30 shown in FIG. 4. Moreover, the aforementioned protrusions of the connecting member 48 are fitted to engage from the inner side in the through holes 31 of the rigid unit 30 positioned at the connection end, and the substantially crescent protrusions are fitted to engage from the inner side in the slots. As a result, the slide guide frame portions 29 are connected into a single structure through the connecting member 48 so that it becomes a structure substantially symmetric on the right and left sides on the connecting member 48.

The slide guide frame portion 29 having free ends on its two right and left ends can be housed in and extracted from the two screen-mounting frame portions 24 and 25. As a result, the transverse width of the screen device 47 at the time when the screen 28 is extended to the full opening of the building is made larger than that of the screen device 23 shown in FIG. 4, thereby to increase the degree of freedom of the ratio of the width and the height in the design of the screen device.

In the screen device 47, moreover, the tension member 33 having its one end 331 fixed at the free end on the left end side of the slide guide frame portion 29 is extracted, as in the tension member 33 shown in FIG. 4, at the portion close to the central portion from the upper end portion of the screen-mounting frame portion 24, to the outside on the side opposite to the mounting side of the screen 28. The extracted tension member 33 is routed along the outer face of the screen-mounting frame portion 24 on the side opposite to the mounting side of the screen 28 toward the upper end of the screen-mounting frame portion 24, and is bent to the left by hooking it on an upper cap 36 attached to the upper end portion of the screen-mounting frame portion 24 so that it is pulled into the upper rail 26. Moreover, the tension member 33 is so bent to the right at the left end portion of the upper rail 26 as to extend to the right end portion of the upper rail 26. The tension member 33 is then hooked to go downward by the upper cap 36 attached to the upper end of the screen-mounting frame portion 25. The tension member 33 extends downward along the outer face of the screen-mounting frame portion 25 on the side opposite to the mounting side of the screen 28, and is pulled from the upper end portion of the screen-mounting frame portion 25 into the inside at a portion close to the central portion. Moreover, the other end 332 is fixed at the free end of the right end side of the slide guide frame portion 29.

Thus, the one end 331 is fixed on the free end of the left end side of the slide guide frame portion 29, and the free end of the right end side and the other end 332 are fixed so that the tension member 33 forms a loop and receives a necessary tension. The tension member 33 is pulled into the screen-mounting frame portions 24 and 25 and into the upper rail 26. The tension member 33 is not exposed to the opening of the building, so that it does not obstruct the opening and closing of the window or the coming and going of the personnel but presents the satisfactory appearance.

In the screen device 47, moreover, the one end 441, which is fixed on the screen-mounting frame portion 25 of the tension member 41 shown in FIG. 4, is fixed at the free end of the right end side of the slide guide frame portion 29, and is tensed, as necessary. The routing of the tension member 41 in the screen-mounting frame portion 25 is made symmetric in connection with the routing in the screen-mounting frame portion 24. The tension member 41 is once bent downward, and is bent upward at the lower end portion of the screen-mounting frame portion 25. Thus, the tension member 41 supports the pleated screen 28 while extending through it in the shrinking and extending directions.

In the screen device 47, the tension member 33, which is supported at its one end 331 and the other end 332 by the free end of the slide guide frame portion 29 and which is pulled into the screen-mounting frame portions 24 and 25, is extracted at the portion close to the central portion from the upper end portions of the two slidable screen-mounting frame portions 24 and 25, to the outside on the side opposite to the mounting side of the screen 28. In case the height size of the screen device 47 is longer than the vertical size such as the opening of the building, therefore, on the upper side of the portion, from which the tension member 33 is extracted to the outside, the screen device 47 is cut by means of a cutting tool such as an electric saw, so that the height size can be cut so short as to match the height size of the opening or the like. By this cutting operation, the screen-mounting frame portions 24 and 25 and the screen 28 are cut all at once, and this cutting operation can be performed without being obstructed by the tension members 33 and 41 and the slide guide frame portion 29 but in the assembled state at the shipping time with the tension members 33 and 41 being wired. The disassembling and reassembling operations to pull, cut and wire the tension members 33 and 41 need not be performed to facilitate the adjustments by cutting the sizes short at the working site.

Here, the other end 332 of the tension member 33 is not fixed, when shipped from the factory, on the free end of the right end side of the slide guide frame portion 29 but is fixed, after adjusted, on the free end of the slide guide frame portion 29, so that the mounting work of the screen device 47 can be further facilitated. In this case, in order to facilitate the fixing of the other end 332 of the tension member 33, it is possible to arrange the crank piece 34 shown in FIG. 4 at the screen-mounting frame portion 25, to make the crank piece 43 of a long member to be arranged in the screen-mounting frame portion 25, and to form a long slit to provide the communication between the inside and outside of the screen-mounting frame portion 25 in the crank piece 34. Through this slit, the side of the other end 332 of the tension member 33 can be easily pulled into the screen-mounting frame portion 25, so that it can be easily fixed on the free end of the slide guide frame portion 29.

Moreover, the screen device 47 can take a structure substantially bilaterally symmetric on the right and left sides with respect to the central portion, in the state where the screen 28 is extended over the entirety of the opening of the building. Therefore, the usability is not different between the right and left sides so that the screen device 47 can be operated with the same feeling even for the screen-mounting frame portions 24 and 25. In the screen device 47, moreover, one of the screen-mounting frame portions 24 and 25 has to be fixed on the inner edge of the opening of the building so that the screen-mounting frame portions 24 and 25 may be kept parallel to each other. In the screen device 47, the screen-mounting frame portion 25 is fixed on the right side of the inner edge of the opening of the building. However, the screen-mounting frame portion 24 can also be fixed on the left side of the inner edge of the opening of the building, thereby to slide the screen-mounting frame portion 25 to the right and left. The operability and the stable parallel movement of the screen-mounting frame portions 24 and 25 are improved by the tension member 33 forming the aforementioned loop.

Figure 8:
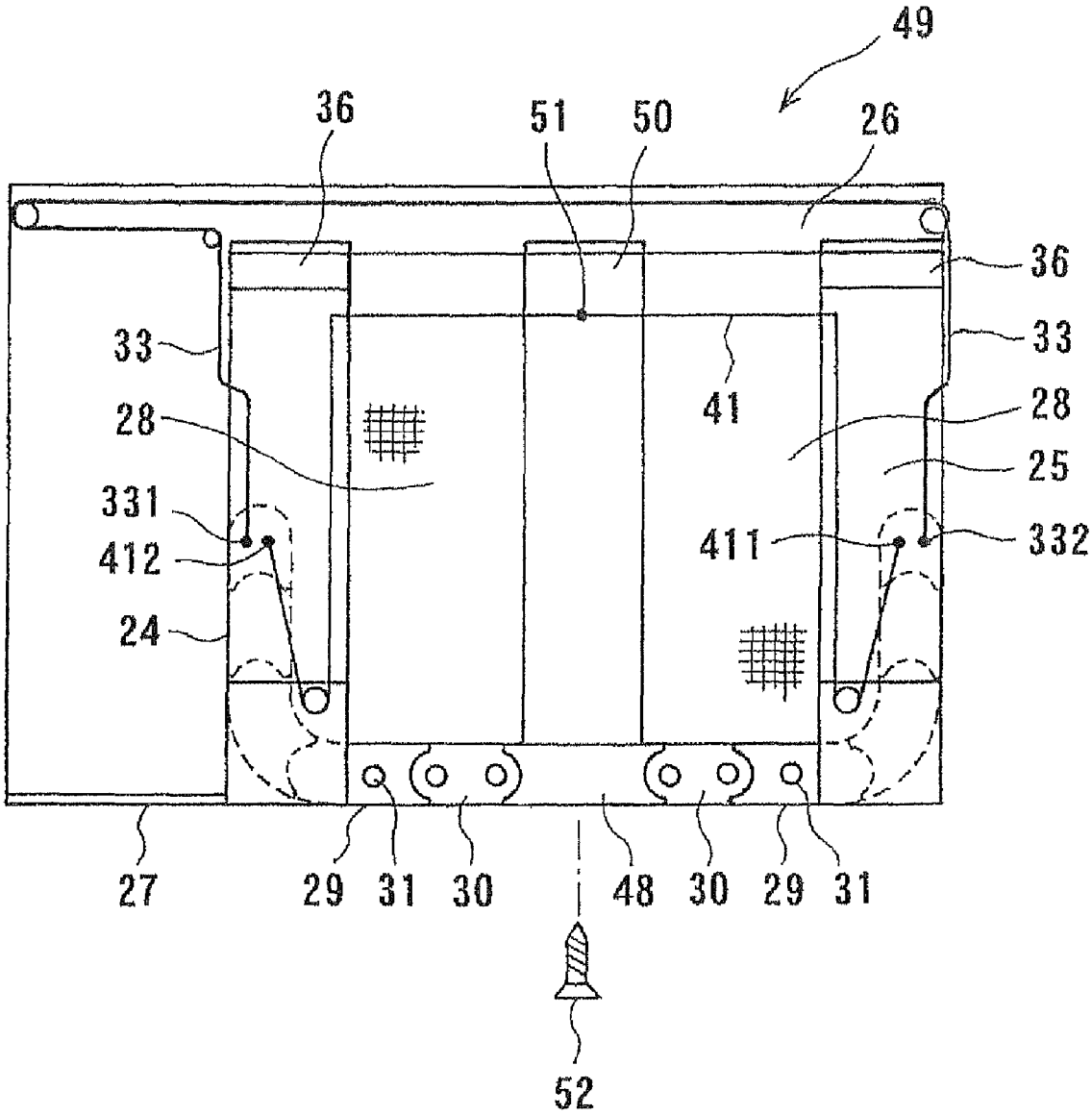
FIG. 8 is a front elevation showing one embodiment of the screen device of the invention, as a modification of the screen device shown in FIG. 7.

In a screen device 49 shown in FIG. 8, a center pillar 50 is arranged between the left and right screen-mounting frame portions 24 and 25. The center pillar 50 can slide to the right and left like the two screen-mounting frame portions 24 and 25. The screen 28 is arranged on the two right and left sides across the center pillar 50. Specifically, the left screen 28 is so mounted between the screen-mounting frame portion 24 and the center pillar 50 as can shrink and extend, and the right screen 28 is mounted between the screen-mounting frame portion 25 and the center pillar 50.

In the screen device 49, moreover, the tension member 41, which supports the screens 28 therethrough in the shrinking and extending directions, is shared between the screens 28 on the two right and left sides, and extends through the two screen 28. The tension member 41 can be provided by one, or two or more, as described hereinbefore, of which at least one tension member 41 is fixed at the fixed point 51 in the center pillar 50.

In the screen device 49, therefore, in accordance with the sliding movements of the screen-mounting frame portion 24 to the right and left, the center pillar 50 also slides and moves in the same direction as the sliding direction of the screen-mounting frame portion 24 so that the right and left screens 28 extend and shrink. These screens 28 thus folded and shrunken are individually housed between the center pillar 50 and the screen-mounting frame portion 24 and between the center pillar 50 and the screen-mounting frame portion 25. In order to house the screens 28 in that manner, the center pillar 50 can be equipped with the recessed screen housing portions like the screen-mounting frame portions 24 and 25. In case the screen-mounting frame portion 24 is fixed whereas the screen-mounting frame portion 25 is slid and moved to the right and left, moreover, the center pillar 50 also slides and moves to the right and left.

Like the screen-mounting frame portions 24 and 25, the center pillar 50 can be made of vertically extending hollow bar-shaped members, which can be extrusion-molded of a light material such as aluminum.

Moreover, the screen device 49 is equipped with the center pillar 50, as described above, and at least one tension member 41 is fixed at the center pillar 50 so that its resisting performance against the wind pressure is enhanced. The shape and structure can be stably held even against a high wind. Even if the screen device is wide, moreover, its housing allowance is expanded by the center pillar 50. As a result, the screen 28 to be folded and shrunken can be completely housed so that it is not be exposed to present the satisfactory appearance and to be hardly blotted when housed. The screen device 49 can also be formed by adding one more center pillar 50 and one more screen 28 to the screen device 47 shown in FIG. 7. The screen device 47 shown in FIG. 7 is prepared as a basis, and the center pillar 50 and the screen 28 are added later according to the working site, so that the screen device 49 can be made so wide as to match the size of the opening.

Moreover, the screen device 49 is based on the screen device 47 shown in FIG. 7, so that it can attain a similar effect such as the adjustment of a height size as in the screen device 47.

In case the center pillar 50 is thus arranged, the parallel relations between the screen-mounting frame portions 24 and 25 and the center pillar 50 can be adjusted by adjusting the lengths in the tension member 41 from the fixed point 51 fixed in the center pillar 50 to the one end 441 and from the fixed point 51 to the other end 412.

In order to realize the parallel relations between the screen-mounting frame portions 24 and 25 and the center pillar 50 more reliably and stably, moreover, the center pillar 50 can be fixed on the slide guide frame portion 29 at the connecting member 48 by means of a screw 52 as shown in FIG. 8, so that the tension member 41 to be fixed on the center pillar 50 can be positioned as highly as possible in the screen 28.

Figure 9:
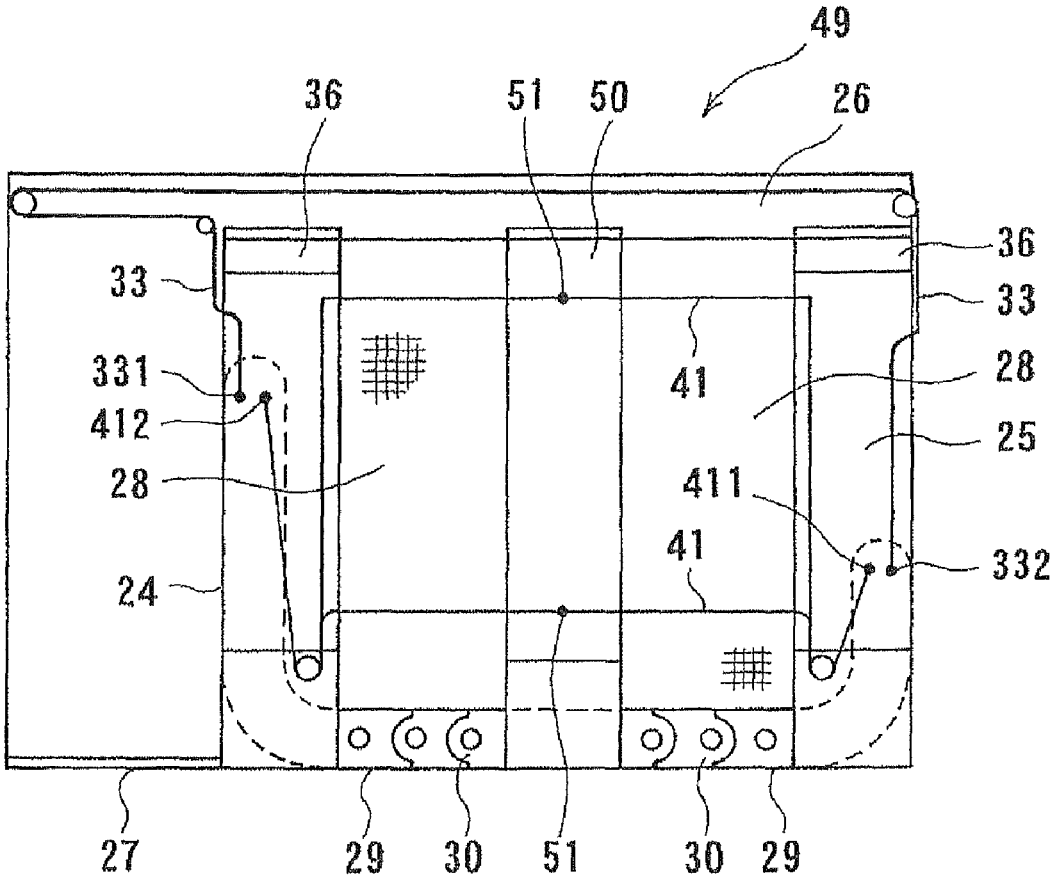
FIG. 9 is a front elevation showing one embodiment of the screen device of the invention, as a modification of the screen device shown in FIG. 8.

In addition, as shown in FIG. 9, the center pillar 50 is not fixed at the slide guide frame portion 29 but can be slid and moved to the right and left along the slide guide frame portion 29. The tension member 41 can be extended through the two upper and lower positions of the screen 28, and the tension member 41 can be fixed at the fixed point 51 in the two upper and lower portions of the center pillar 50.

Figure 10:
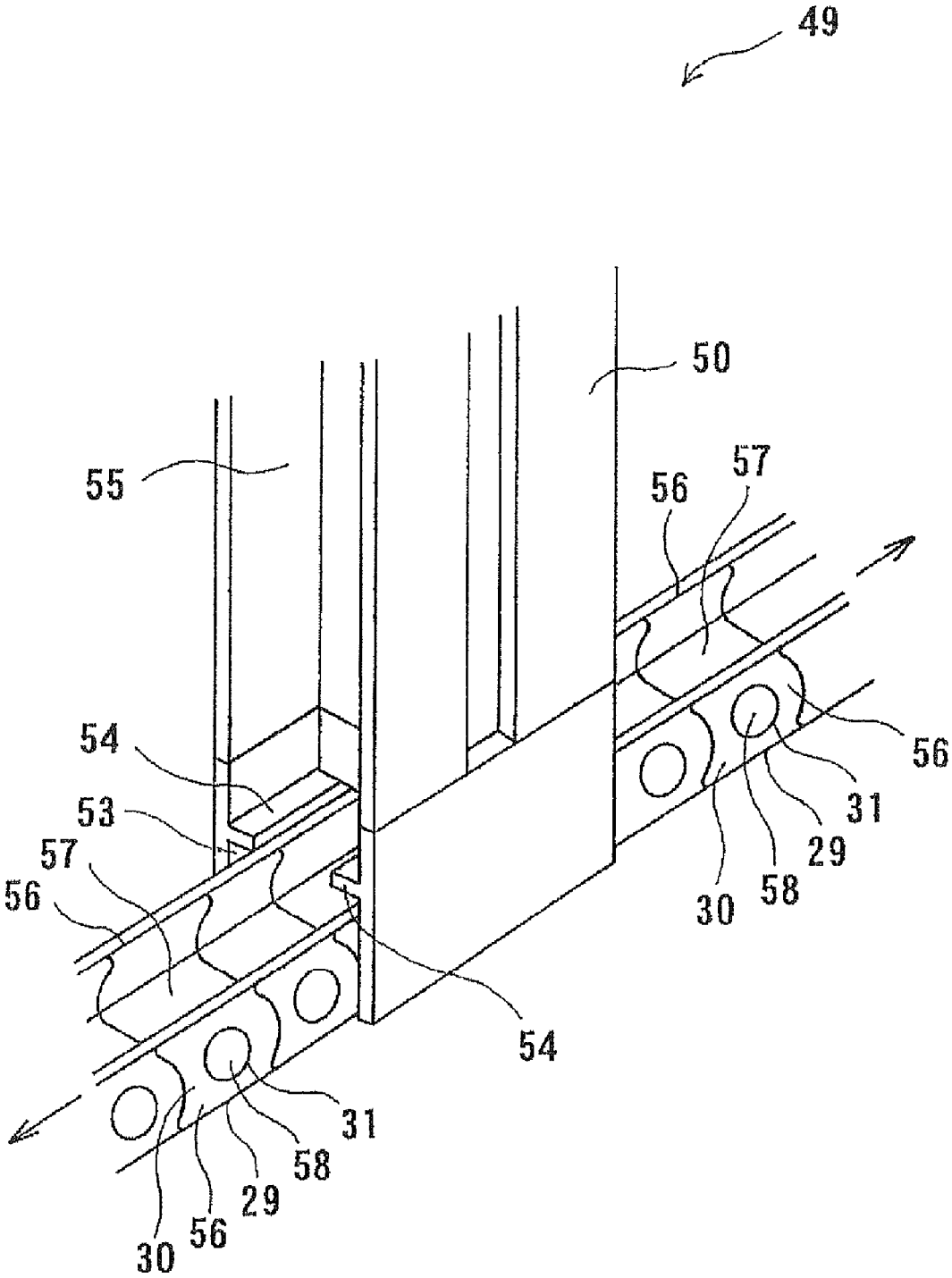
FIG. 10 is a perspective view of an essential portion showing the periphery of the center pillar of the screen device shown in FIG. 9.

In this case, as shown in FIG. 10 showing the periphery of the center pillar 50 partially, the center pillar 50 can have a guide portion 53 formed to extend therethrough bilaterally in the lower end portion of the center pillar 50, and a guide rib 54 protruding inward from the front portion and the back portion of the center pillar 50 can be formed on the upper end of the guide portion 53. By passing the slide guide frame portion 29 bilaterally in the guide portion 53, the center pillar 50 slides in contact on the slide guide frame portion 29 on at least either the inner face of the guide portion 53 and the lower face of the guide rib 54 so that the center pillar 50 can slide and move to the right and left along the slide guide frame portion 29. Moreover, the sliding movement of the center pillar 50 is stably performed without any interference with the movement of the slide guide frame portion 29 to be housed and extracted.

In the center pillar 50, as shown in FIG. 10, recessed housing portions 55 for the screen 28 can be formed in the right and left side face portions.

Moreover, the rigid unit 30 forming the slide guide frame portion 29 has a pair of sidewall portions 56 arranged to confront each other, and bridge portions 57 connecting the two sidewall portions 56 to each other. The side wall portion 56 has a protrusion 58 so formed in one longitudinal end portion as to protrude to the outside, and the through hole 31 so formed in the other end portion as to be engaged by the protrusion 58. Although the illustration is omitted from FIG. 10, the side wall portion 56 has the small protrusion so arranged adjacent to the protrusion 58 and on the opposite side of the through hole 31 as to protrude to the outside, and has the substantially crescent slot formed adjacent to the through holes 31 and on the side of the protrusion 58 as to correspond to the slot 32 shown in FIG. 4.

Figure 11:
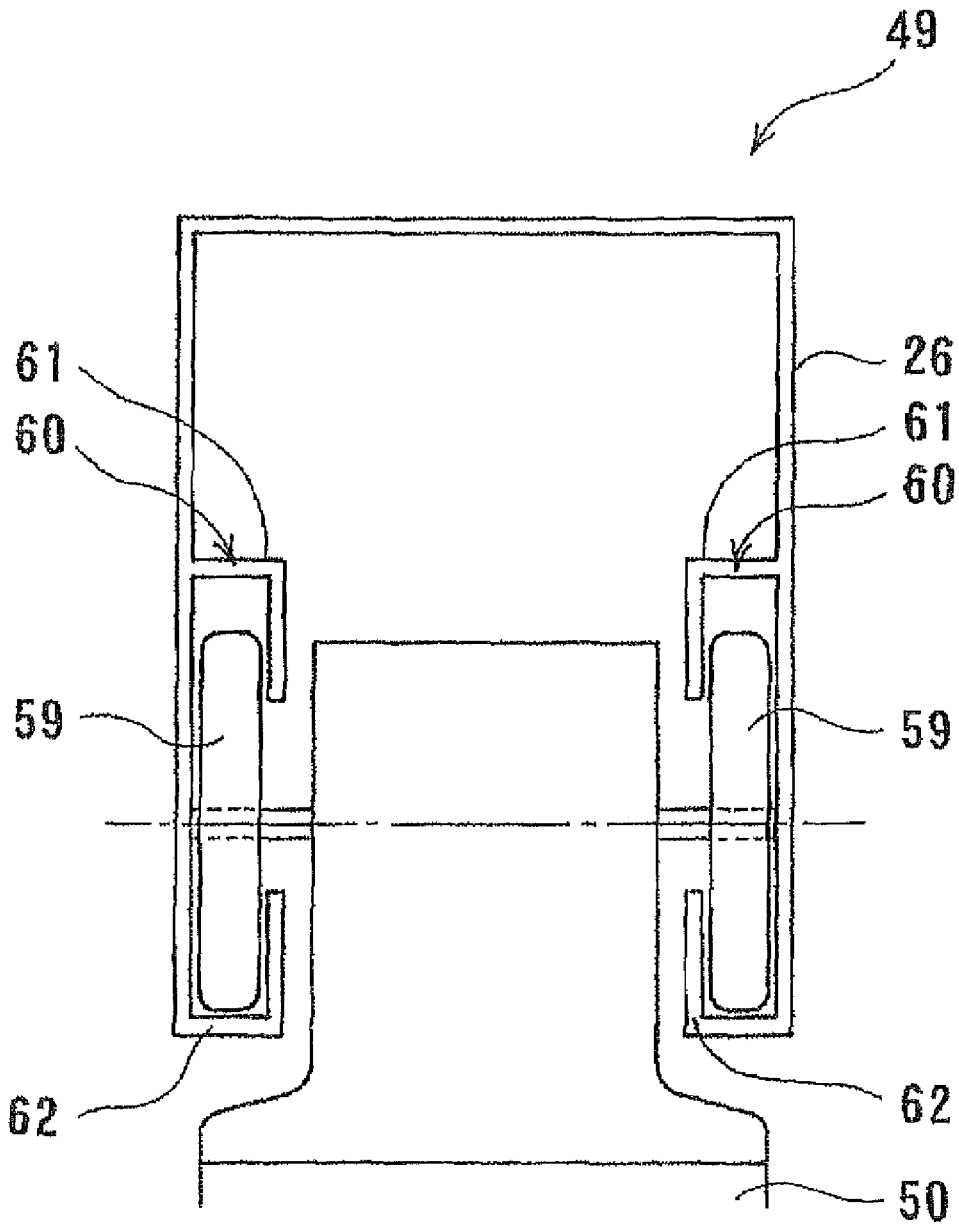
FIG. 11 is a section showing an essential portion of one embodiment of the screen device of the invention, as a modification of the screen device shown in FIG. 8.

In addition, in order to realize the parallel relation between the screen-mounting frame portions 24 and 25 and the center pillar 50 more reliably and stably, the center pillar 50 is not only unfixed on the slide guide frame portion 29 but also unrelated from the slide guide frame portion 29 as shown in FIG. 11, and has its lower end arranged to such an extent as to have no interference with the slide guide frame portion 29 so that it can be suspended at its upper end portion from the upper rail 26. In this case, like the screen device 49 shown in FIG. 9, the tension member 41 is extended through the two upper and lower portions of the screen 28, and is fixed on the fixed point 51 at the two upper and lower portions of the center pillar 50.

Rotatable runners 59 are arranged on the two sides of the surface side and the back side of the upper end portion of the center pillar 50. On the inner sides of the surface portion and the back portion of the upper rail 26, there are arranged runner rails 60 for guiding the runner 59. The runner rails 60 are formed of rail members 61 extended near the central portion of the upper rail 26 in the height direction and having a generally L-shaped section folded downward, and rail members 62 extended from the lower end of the upper rail 26 and having a generally L-shaped section folded upward. The runners 59 are inserted between the rail members 61 and 62 of the runner rails 60 so that they can rotate along the runner rails 60 without coming out of the runner rails 60. These rotations allow the center pillar 50 to slide to the right and left of the screen device 49.

The screen-mounting frame portions 24 and 25 are usually placed vertically of a reference face such as the floor face, so that the center pillar 50 suspended at the upper end portion by the upper rail 26 can keep its parallel relation to the screen-mounting frame portions 24 and 25 by its own weight.

The invention claimed is:

1. A screen device comprising:

a pair of screen-mounting frame portions arranged to confront each other, one of the screen-mounting frame portions being a slidable screen-mounting frame portion which is slidably movable;

an extendable and contractible screen mounted between the screen-mounting frame portions;

an upper cap detachably mounted to an upper end portion of the slidable screen-mounting frame portion;

a tension member extending through the screen and supporting the screen in extending and contracting directions thereof, the tension member being routed in the screen-mounting frame portions; and a slide guide frame portion arranged near a lower end portion of the screen, the slide guide frame portion including a plurality of rigid units turnable connected to each other, each rigid unit including a pair of side wall portions arranged to confront each other and a bridge portion connecting the side wall portions, wherein the tension member is configured to be hooked on the upper cap and bend at the upper cap, wherein the tension member is extracted from the upper end portion of the slidable screen-mounting frame portion and disposed externally of the slidable screen-mounting frame portion on a side opposite to a screen mounting side, wherein the slide guide frame portion is bendable and has at least one free end such that the slide guide frame portion is housed in and extracted from the slidable screen-mounting frame portion as the screen-mounting frame portion slides and moves, and such that an extracted portion of the slide guide frame portion maintains linearity when it is extracted from the screen-mounting frame portion as the screen-mounting frame portion slides and moves, and wherein a first end of the tension member is fixed at the free end of the slide guide frame portion.

2. The screen device of claim 1, wherein both of the screen-mounting frame portions are slidably movable.

3. The screen device of claim 1, further comprising a doorstop arranged to confront the slidable screen-mounting frame portion, wherein a second end of the tension member is fixed at the doorstop.

4. The screen device of claim 1, further comprising an upper rail for guiding the slide movement of the slidable screen-mounting frame portion at an upper end portion of the slidable screen-mounting frame portion, wherein a second end of the tension member is fixed at the upper rail.

5. The screen device of claim 1, further comprising an upper rail for guiding the slide movement of the slidable screen-mounting frame portion at an upper end portion of the slidable screen-mounting frame portion, wherein both of the screen-mounting frame portions are slidably movable, and the slide guide frame portion has two free ends and can be housed in and extracted from both of the screen-mounting frame portions, wherein a second end of the tension member is configured to be fixed to one of the free ends of the slide guide frame portion opposite to the free end to which the first end of the tension member is connected, and wherein the tension member is configured to be routed through the upper rail to form a loop.

6. The screen device of claim 5, further comprising a center pillar arranged between the screen-mounting frame portions, the center pillar being slidably movable in the same direction as the two screen-mounting frame portions, wherein the tension member is fixed on the center pillar.

* * * * *